US012577722B2

(12) United States Patent
Neelapala et al.

(10) Patent No.: US 12,577,722 B2
(45) Date of Patent: Mar. 17, 2026

(54) STACKING MOUNT ASSEMBLY FOR MOUNTING A PAIR OF LAUNDRY APPLIANCES

(71) Applicant: Haier US Appliance Solutions, Inc., Wilmington, DE (US)

(72) Inventors: Gopinath Yadav Neelapala, Louisville, KY (US); Cody Michael Ratchford, Louisville, KY (US); Venkata Chakradhar Rangu, Louisville, KY (US); Venugopal Gonala, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 52 days.

(21) Appl. No.: 18/665,721

(22) Filed: May 16, 2024

(65) Prior Publication Data

US 2025/0354322 A1 Nov. 20, 2025

(51) Int. Cl.
*D06F 39/12* (2006.01)
*D06F 29/00* (2006.01)

(52) U.S. Cl.
CPC ..... *D06F 39/125* (2013.01); *D06F 29/005* (2013.01)

(58) Field of Classification Search
CPC ..... D06F 39/125
See application file for complete search history.

(56) References Cited

U.S. PATENT DOCUMENTS

| | | | |
|---|---|---|---|
| 4,462,225 | A | 7/1984 | Noe |
| 7,685,846 | B2 | 3/2010 | Hwang et al. |

FOREIGN PATENT DOCUMENTS

| | | | |
|---|---|---|---|
| CN | 208414873 | U | 1/2019 |
| CN | 215887580 | U | 2/2022 |
| CN | 216786583 | U | 6/2022 |
| DE | 19905742 | B4 | 1/2010 |
| EP | 0618322 | B1 | 11/1999 |

*Primary Examiner* — Jason Y Ko
(74) *Attorney, Agent, or Firm* — Dority & Manning, P.A.

(57) ABSTRACT

A stacking mount assembly for mounting a pair of laundry appliances may include a rack assembly may include a pair of racks. Each rack may include a vertical support beam, a top bracket positioned at a top of the respective vertical support beam, and a bottom bracket positioned at a bottom of the respective vertical support beam. A first laundry appliance of the pair of laundry appliances mounted to each top bracket of the pair of racks. A second laundry appliance of the pair of laundry appliances secured to a first predetermined surface at each bottom bracket of the pair of rack. The stacking mount assembly may include a crossbeam attached to the rack assembly for bracing the rack assembly. The crossbeam may include a pair of beams attached between the pair of racks. The pair of beams may be arranged in a cross formation.

20 Claims, 8 Drawing Sheets

STACKING MOUNT ASSEMBLY FOR MOUNTING A PAIR OF LAUNDRY APPLIANCES

FIELD OF THE DISCLOSURE

The present subject matter relates generally to laundry appliances and more particularly to features for mounting laundry appliances.

BACKGROUND OF THE DISCLOSURE

Laundry appliances generally include washing machine appliances and dryer appliances. Such laundry appliances are typically paired, such that after washing a load of articles in the washing machine appliance of the pair, the load of articles may be easily transferred to the dryer appliance that is paired with the washing machine appliance.

Some laundry appliances are positioned within locales that are occupied only temporarily, such as recreational vehicles (RVs), mobile homes, and the like. A full-size washer/dryer pair of appliances can be difficult to install and secure within these locales. Specifically, limited space within the locale often presents challenges when installing a full-size washer/dryer pair of appliances. For example, the limited space can present difficulties for an operator in positioning and securing the full-size washer/dryer pair of appliances within the locale.

Accordingly, systems that would obviate the above-mentioned challenges would be beneficial.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a stacking mount assembly for mounting a dryer appliance and a washing machine appliance is provided. The stacking mount assembly may define a vertical direction, a lateral direction, and a transverse direction. The stacking mount assembly may include a rack assembly comprising a first rack and a second rack spaced apart along the lateral direction a rack assembly. The first rack may include a first vertical support beam, a first top bracket, and a first bottom bracket. The first top bracket being positioned at a top end of the first vertical support beam. The first bottom bracket being positioned at a bottom end of the first vertical support beam. The second rack may include a second vertical support beam, a second top bracket, and a second bottom bracket. The second top bracket being positioned at a top end of the second vertical support beam. The second bottom bracket being positioned at a bottom end of the second vertical support beam. The stacking mount assembly may include a crossbeam for bracing the rack assembly. The crossbeam may include a first beam and a second beam. The first beam and the second beam each may extend between the first vertical support beam and the second vertical support beam. The first beam and the second beam arranged in a cross formation. The stacking mount assembly may include a front foot assembly. The front foot assembly may include a first font foot bracket and a second front foot bracket spaced apart along the lateral direction. The dryer appliance may be mounted to the first top bracket and the second top bracket. Each of the first front foot bracket and the second front foot bracket may define a front foot opening for receiving a front foot of the washing machine appliance.

In another exemplary aspect of the present disclosure, a stacking mount assembly for mounting a pair of laundry appliances is provided. The stacking mount assembly may include a rack assembly. The rack assembly may include a pair of racks spaced apart. Each rack may include a vertical support beam, a top bracket positioned at a top of the respective vertical support beam, and a bottom bracket positioned at a bottom of the respective vertical support beam. A first laundry appliance of the pair of laundry appliances may be mounted to each top bracket of the pair of racks. A second laundry appliance of the pair of laundry appliances secured to a first predetermined surface at each bottom bracket of the pair of rack. The stacking mount assembly may include a crossbeam attached to the rack assembly for bracing the rack assembly. The crossbeam may include a pair of beams attached between the pair of racks. The pair of beams may be arranged in a cross formation.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
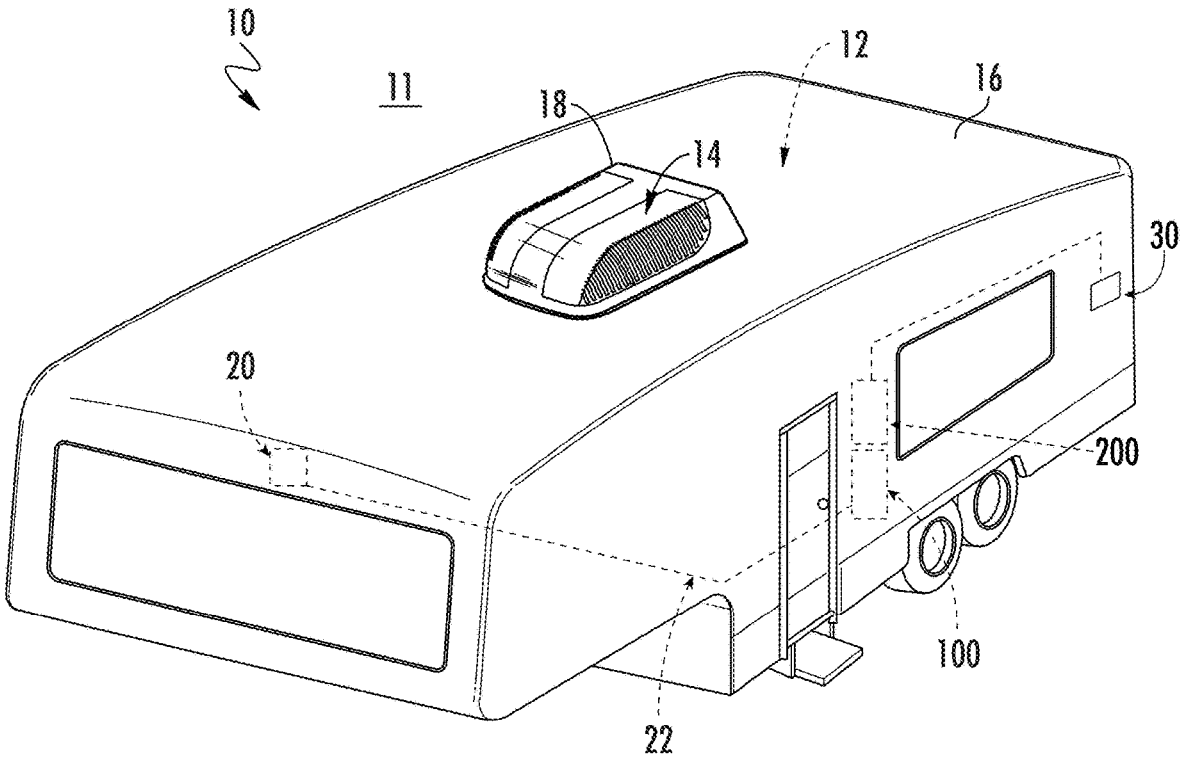
FIG. 1 provides a perspective view of a recreational vehicle according to an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

As used herein, the terms "clothing" or "articles" include but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance (e.g., clothes dryer) and may include a mixture of different or similar articles of clothing of different or similar types and kinds of fabrics, textiles, garments, and linens within a particular laundering process.

According to one or more exemplary embodiments of the present subject matter, a stacking mount assembly may be provided for mounting a washing machine appliance or a dryer appliance within a locale that is moveable or occupied temporarily (e.g., RV 10 described in more detail below or a mobile home). As will be appreciated in more detail below, the stacking mount assembly may allow an operator to securely stack a washing machine appliance or a dryer appliance within a locale that is moveable or occupied temporarily. Specifically, such locales often include small spaces or areas for accommodating washing machine appliances or dryer appliances. The stacking mount assembly may advantageously aid in installing, mounting, and securing the washing machine appliance or dryer appliance within the small spaces or areas.

Referring now to the figures, FIG. 1 provides a perspective view of a recreational vehicle (RV) 10 in accordance with the present disclosure. People may employ RV 10 for a variety of purposes, including transportation, cooking, eating, sleeping, entertaining, and the like. As such, RV 10 defines a passenger compartment 12, which may further include a bed, stove, table, laundry appliances (e.g., washing machine appliance or dryer appliance described below), restroom, or multiple compartments for storing items that passengers wish to take with them on their travels. RV 10 may further include an air conditioning system 14 including a top cover 18 mounted on an outer surface 16 thereof. Air conditioning system 14 may communicate with an outdoor environment 11 to circulate air within passenger compartment 12. RV 10 described herein is provided by way of example only, and additional or alternative elements, designs, or features may be included or excluded according to specific embodiments.

In some embodiments, RV 10 may include a water supply circuit 22. For instance, water supply circuit 22 may be fluidly connected with, e.g., a washing machine appliance 1000 positioned within passenger compartment 12. Water supply circuit 22 may include one or more tubes, pipes, hoses, or other conduits through which water (or any suitable liquid) may be supplied to washing machine appliance 1000. In some instances, water supply circuit 22 extends throughout RV 10 (e.g., through passenger compartment 12) such that multiple appliances requiring water are attached thereto. Water supply circuit 22 may include an inlet. For instance, a municipal (or external) water source 20 may be connected at inlet to supply water to RV 10. According to some instances, inlet 24 may be positioned distal to a location of a connected appliance, such as a washing machine appliance (e.g., first laundry appliance 100 described in more detail below).

In some embodiments, RV 10 may include an exhaust system 30. For instance, the exhaust system 30 may communicate with the outdoor environment 11 to exhaust air, e.g., from a dryer appliance (e.g., second laundry appliance 200 described in more detail below) that may be positioned within the passenger compartment 12. Exhaust system may include one or more ducts, pipes, hoses, or other conduits through which exhaust air may be expelled from the dryer appliance to the outdoor environments 11.

Figure 2:
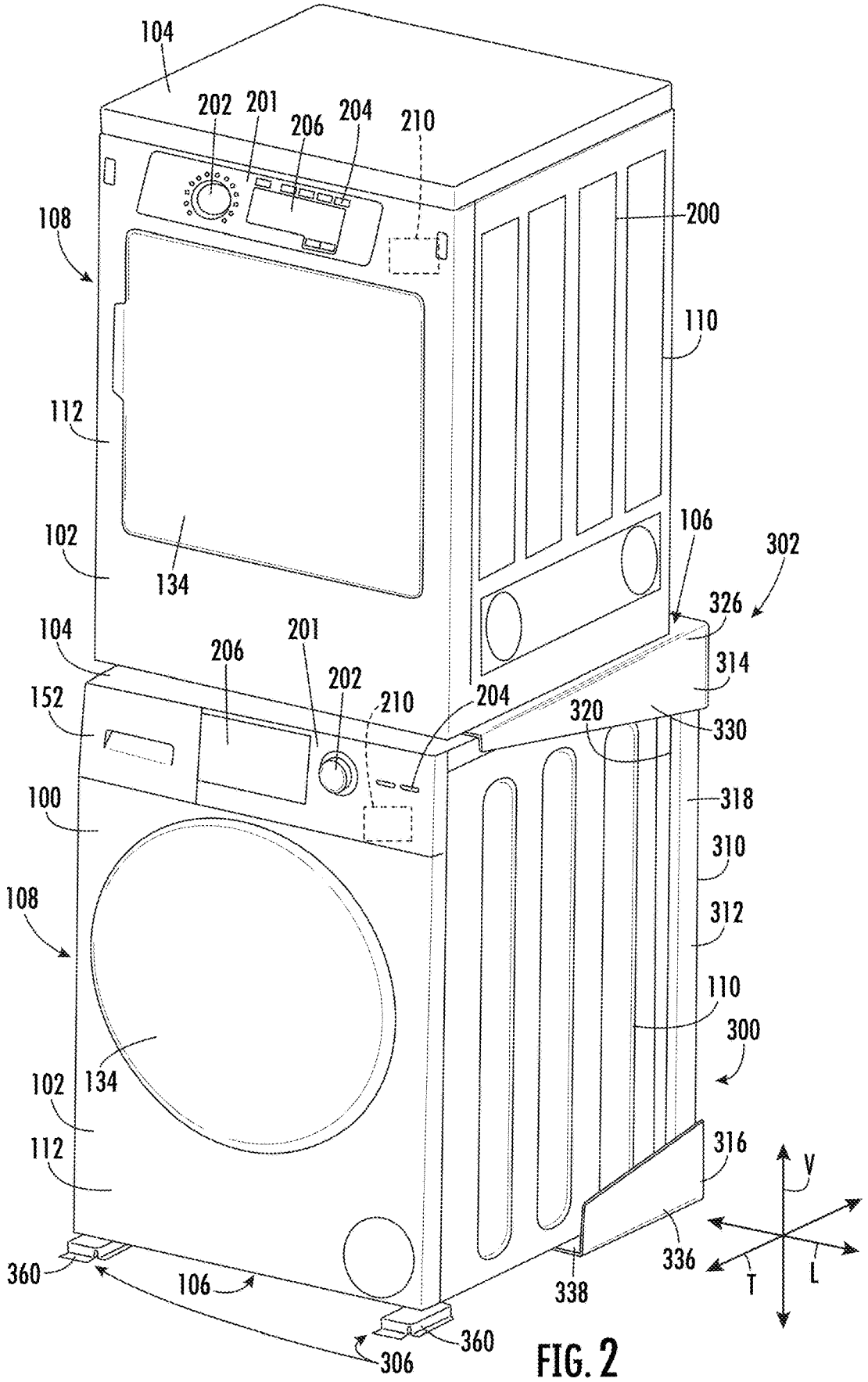
FIG. 2 provides a perspective view of a dryer appliance and a washing machine appliance mounted on a stacking mount assembly that can be positioned within the recreational vehicle of FIG. 1 according to one or more exemplary embodiments of the present disclosure.
Figure 3:
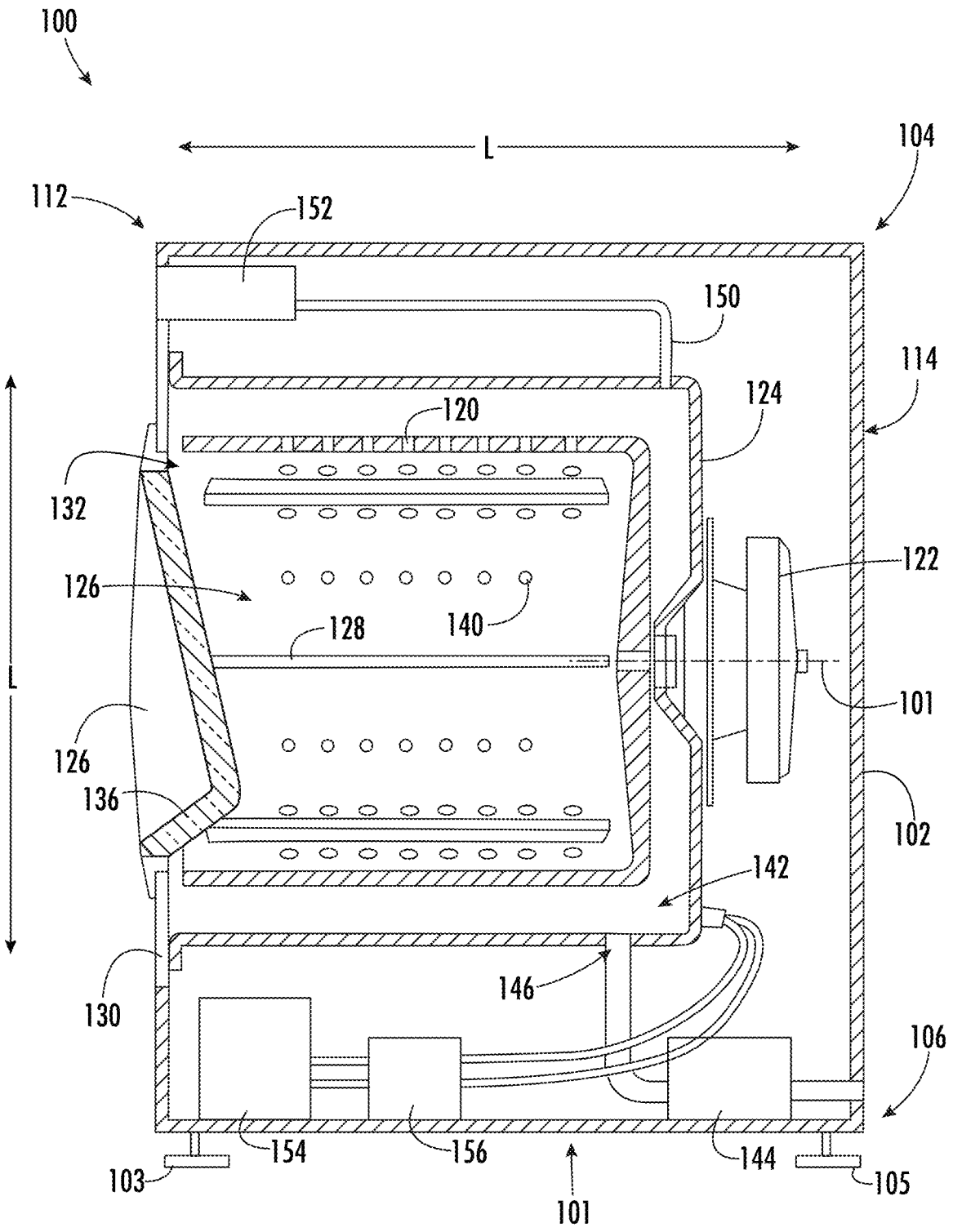
FIG. 3 provides a transverse cross-sectional view of the exemplary washing machine appliance of FIG. 2.
Figure 4:
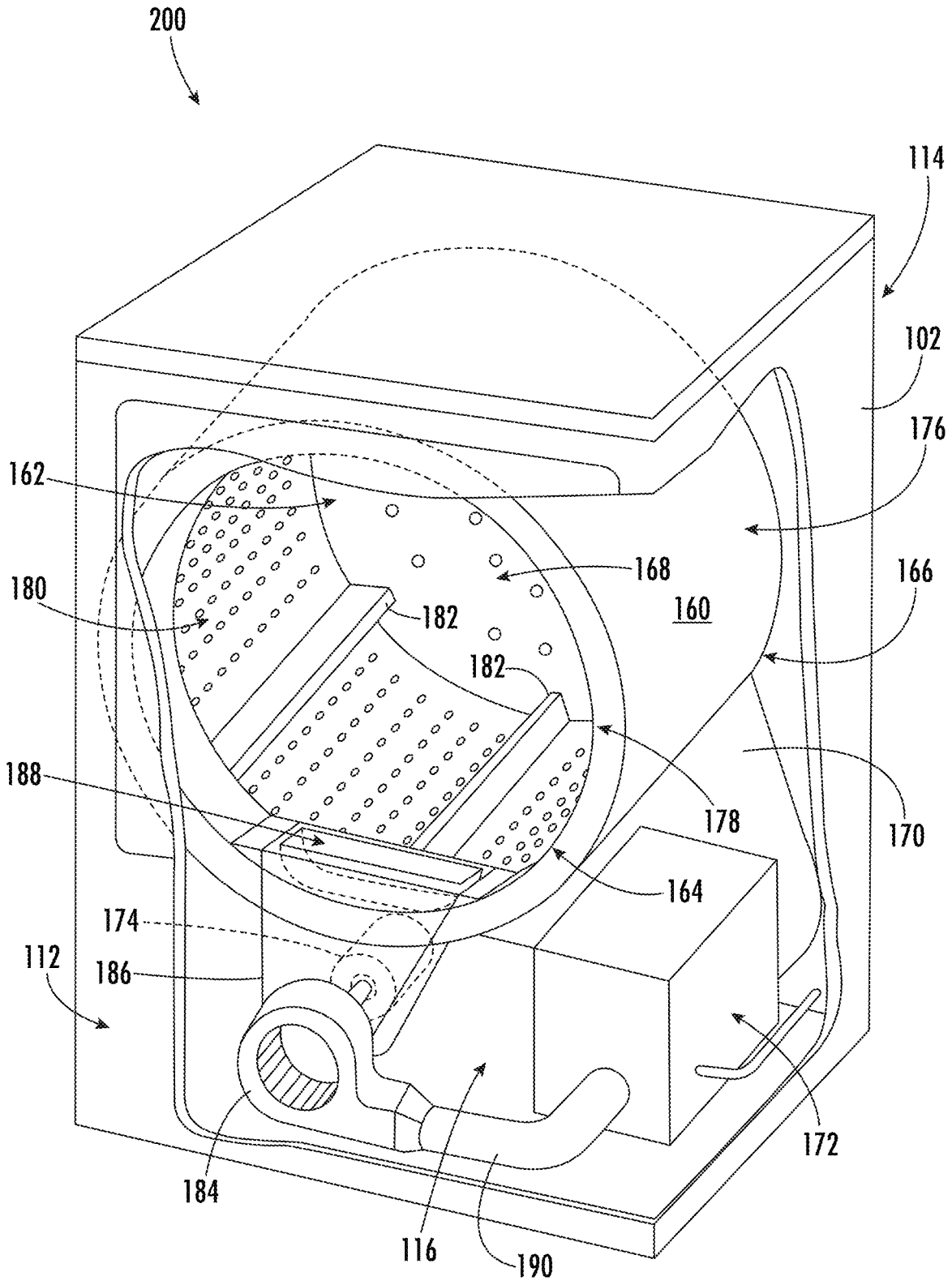
FIG. 4 provides a perspective view of the exemplary dryer appliance of FIG. 2 with portions of a cabinet of the dryer appliance removed to reveal certain components of the dryer appliance.

As may be seen, e.g., in FIGS. 2 through 4, embodiments of the present subject matter may pertain to a stacking mount assembly 300. In some embodiments, the stacking mount assembly 300 defines a vertical direction, a lateral direction, and a transverse direction. The vertical direction, the lateral direction, and the transverse direction may be mutually perpendicular to define an orthogonal coordinate system. The stacking mount assembly 300 may be utilized in stacking a pair of laundry appliances (e.g., a first laundry appliance 100 and a second laundry appliance 200) within a dedicated space (e.g., an alcove or a closet) within a predetermined locale (e.g., a location that is moveable or occupied temporarily such as RV 10 or a mobile home). In some embodiments, the first laundry appliance 100 or the second laundry appliance 200 may be a washing machine appliance or a dryer appliance. For example, as generally seen throughout FIGS. 2 through 4, the first laundry appliance 100 may be a washing machine appliance and the second laundry appliance 200 may be a dryer appliance.

The pair of laundry appliances may each include a cabinet 102. Each cabinet 102 extends between a top side 104 and a bottom side 106 along the vertical direction V. Each cabinet 102 also extends between a first side 108 and a second side 110, e.g., along the lateral direction L. Each cabinet 102 further extends between a front side 112 and a rear side 114 spaced apart from each other along the transverse direction T. Within cabinet 102, an interior volume 116 is defined.

In some embodiments, the first laundry appliance 100 or the second laundry appliance 200 includes a plurality of leveling legs for adjusting the height of the first laundry appliance 100 or the second laundry appliance 200, respectively. For example, as illustrated in FIG. 3, the first laundry appliance 100 may include four leveling legs, and more particularly, two front leveling legs 103 and two rear leveling legs 105. The four leveling legs may be positioned proximately to the corners of a bottom 101 of cabinet 102. Particularly, the two front leveling legs 103 may be positioned proximate the two front most corners of the bottom 107 of the cabinet 102 and the two rear leveling legs 105 may be positioned proximate the two rear most corners of the bottom 101 of the cabinet 102. The plurality of leveling legs may generally have different sizes, positions, geometries, extension lengths, etc. Although exemplary leveling legs are illustrated herein, it should be appreciated that the number, size, position, and geometries of such legs may vary while remaining within the scope of the present subject matter. In addition, though not illustrated, in some embodiments, the second laundry appliance 200 includes a plurality of leveling legs.

Additional exemplary details of the laundry appliances are illustrated in FIGS. 2 and 3. For example, FIG. 3 provides a cross-sectional view of the exemplary first laundry appliance 100. As mentioned above, the first laundry appliance 100 may be a washing machine appliance. As illustrated in FIG. 3, a wash tub 124 is non-rotatably mounted within cabinet 102. As may be seen in FIG. 3, the wash tub 124 defines a central axis 101. In the example embodiment illustrated by FIG. 3, the central axis 101 may be oriented generally along or parallel to the transverse direction T of the first laundry appliance 100. Accordingly, the first laundry appliance 100 may be referred to as a horizontal axis washing machine.

Referring specifically to FIG. 3, a wash basket 120 is rotatably mounted within the wash tub 124 such that the wash basket 120 is rotatable about an axis of rotation, which generally coincides with central axis 101 of the wash tub 124. A motor 122, e.g., such as a pancake motor, is in mechanical communication with wash basket 120 to selectively rotate wash basket 120 (e.g., during an agitation or a rinse cycle of first laundry appliance 100). Wash basket 120 defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. The wash basket 120 and the wash tub 124 may collectively define at least a portion of a tub assembly for the first laundry appliance 100.

Wash basket 120 may define one or more agitator features that extend into wash chamber 126 to assist in agitation and cleaning of articles disposed within wash chamber 126 during operation of first laundry appliance 100. For example, as illustrated in FIG. 2, a plurality of ribs 128 extends from wash basket 120 into wash chamber 126. In this manner, for example, ribs 128 may lift articles disposed in wash basket 120 during rotation of wash basket 120.

Cabinet 102 also includes a front panel 130 which defines an opening 132 that permits user access to wash basket 120 within wash tub 124. More specifically, first laundry appliance 100 includes a door 134 that is positioned in front of opening 132 and is rotatably mounted to front panel 130. Door 134 is rotatable such that door 134 permits selective access to opening 132 by rotating between an open position (not shown) facilitating access to a wash tub 124 and a closed position (FIG. 2) prohibiting access to wash tub 124.

A window 136 in door 134 permits viewing of wash basket 120 when door 134 is in the closed position, e.g., during operation of first laundry appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

A wash basket 120 may also define a plurality of perforations 140 in order to facilitate fluid communication between an interior of wash basket 120 and wash tub 124. A sump 142 is defined by wash tub 124 at a bottom of wash tub 124 along the vertical direction V. Thus, sump 142 is configured for receipt of and generally collects wash fluid during operation of first laundry appliance 100. For example, during operation of first laundry appliance 100, wash fluid may be urged by gravity from wash basket 120 to sump 142 through plurality of perforations 140. A pump assembly 144 is located beneath wash tub 124 for gravity assisted flow when draining the wash tub 124, e.g., via a drain 146. Pump assembly 144 may be configured for recirculating wash fluid within wash tub 124.

A spout 150 is configured for directing a flow of fluid into wash tub 124. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

A detergent drawer 152 may be slidably mounted within front panel 130. Detergent drawer 152 may receive a wash additive (e.g., detergent, fabric softener, bleach, or any other suitable liquid or powder) and directs the fluid additive to wash tub 124 during operation of first laundry appliance 100. According to the illustrated embodiment, detergent drawer 152 is fluidly coupled to spout 150 to facilitate the complete and accurate dispensing of wash additive.

Additionally, a bulk reservoir 154 may be disposed within cabinet 102. Bulk reservoir 154 may also be configured for receipt of fluid additive for use during operation of first laundry appliance 100. Bulk reservoir 154 is sized such that a volume of fluid additive sufficient for a plurality or multitude of wash cycles of first laundry appliance 100 (e.g., five, ten, twenty, fifty, or any other suitable number of wash cycles) may fill bulk reservoir 154. Thus, for example, a user can fill bulk reservoir 154 with fluid additive and operate first laundry appliance 100 for a plurality of wash cycles without refilling bulk reservoir 154 with fluid additive. A reservoir pump 156 is configured for selective delivery of the fluid additive from bulk reservoir 154 to wash tub 124.

During operation of first laundry appliance 100, e.g., during a wash cycle of the first laundry appliance 100, laundry items are loaded into wash basket 120 through opening 132, and washing operation is initiated through operator manipulation of one or more input selectors (e.g., as knobs 202, buttons 204, or displays 206). Wash tub 124 is filled with water, detergent, or other fluid additives, e.g., via spout 150 or detergent drawer 152. One or more valves (not shown) can be controlled by first laundry appliance 100 to provide for filling wash basket 120 to the appropriate level for the amount of articles being washed or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle or after the rinse cycle in order to wring wash fluid from the articles being washed. During a spin cycle, wash basket 120 is rotated at relatively high speeds. After articles disposed in wash basket 120 are cleaned or washed, the user can remove the articles from wash basket 120, e.g., by opening door 134 and reaching into wash basket 120 through opening 132.

While described in the context of a specific embodiment of horizontal axis washing machine appliance, using the teachings disclosed herein it will be understood that horizontal axis washing machine appliance is provided by way of example only. It should be appreciated that the present subject matter is not limited to any particular style, model, or configuration of washing machine appliance. Other washing machine appliances having different configurations, different appearances, or different features may also be utilized with the present subject matter as well, e.g., vertical axis washing machine appliances.

Referring now to FIG. 4, a perspective view of the second laundry appliance 200 of FIG. 2, which is an example embodiment of a dryer appliance, with a portion of a cabinet or cabinet 102 of second laundry appliance 200 removed in order to show certain components of second laundry appliance 200 is provided. While described in the context of a specific embodiment of dryer appliance, using the teachings disclosed herein, it will be understood that the dryer appliance is provided by way of example only. Other dryer appliances having different appearances and different features may also be utilized with the present subject matter as well.

A container or drum 160 is mounted for rotation about a substantially horizontal axis within the interior volume 116. Drum 160 defines a chamber 162 for receipt of articles of clothing for tumbling or drying. Drum 160 extends between a front portion 164 and a back portion 166. Drum 160 also includes a back or rear wall 168, e.g., at back portion 166 of drum 160. A supply duct 170 may be mounted to rear wall 168 and receives heated air that has been heated by a heating system 172.

A motor 174 is provided in some embodiments to rotate drum 160 about the horizontal axis, e.g., via a pulley and a belt (not pictured). Drum 160 is generally cylindrical in shape, having an outer cylindrical wall 176 and a front flange or wall 178 that defines an opening 180 of drum 160, e.g., at front portion 164 of drum 160, for loading and unloading of articles into and out of chamber 162 of drum 160. A plurality of lifters or baffles 182 are provided within chamber 162 of drum 160 to lift articles therein and then allow such articles to tumble back to a bottom of drum 160 as drum 160 rotates. Baffles 182 may be mounted to drum 160 such that baffles 182 rotate with drum 160 during operation of second laundry appliance 200.

The rear wall 168 of drum 160 may be rotatably supported within the cabinet 102 by a suitable fixed bearing. Rear wall 168 can be fixed or can be rotatable. Rear wall 168 may include, for instance, a plurality of holes that receive hot air that has been heated by heating system 172. The heating system 172 may include, e.g., a heat pump, an electric heating element, or a gas heating element (e.g., gas burner). Moisture laden, heated air is drawn from drum 160 by an air handler, such as blower fan 184, which generates a negative air pressure within drum 160. The moisture laden heated air passes through a duct 186 enclosing screen filter 188, which traps lint particles. As the air passes from blower fan 184, it enters a duct 190 and then is passed into heating system 172. In some embodiments, the second laundry appliance 200 may be a conventional dryer appliance, e.g., the heating system 172 may be or include an electric heating element, e.g., a resistive heating element, or a gas-powered heating element, e.g., a gas burner. In other embodiments, the dryer appliance may be a condensation dryer, such as a heat pump dryer. In such embodiments, heating system 172 may be or include a heat pump including a sealed refrigerant circuit. Heated air (with a lower moisture content than was received from drum 160), exits heating system 172 and returns to drum 160 by duct 186. After the clothing articles have been dried, they are removed from the drum 160 via opening 180. A door (FIG. 2) provides for closing or accessing drum 160 through opening 180.

Referring now back to FIG. 2, the pair of laundry appliances (e.g., the first laundry appliance 100 or the second laundry appliance 200) may each include a control panel 201. Each control panel 201 may include one or more selector inputs, such as knobs 202, buttons 204, displays 206, etc., may be provided or mounted on the cabinets 102 (e.g., on a front side 112) of the first laundry appliance 100 and the second laundry appliance 200, respectively. The one or more selector inputs of the control panel 201 may be in operable communication (e.g., electrically coupled or coupled through a wireless network band) with a processing device or controller 210. In some embodiments, the respective controller 210 may be in operative communication components of the respective laundry appliance (e.g., the first laundry appliance 100 or the second laundry appliance 200). For example, the controller 210 of the first laundry appliance 100 may be provided in operable communication with components of the first laundry appliance 100 including motor 122, water valves (not shown), or pump assembly 144. In turn signals generated in controller 210 of the first laundry appliance 100 direct operation of motor 122, water valves (not shown), or pump assembly in response to the position of the one or more selector inputs. As another example, the controller 210 of the second laundry appliance 200 may be provided in operable communication with components of the second laundry appliance 200 including motor 174, blower fan 184, or heating system 172. In turn, signals generated in controller 210 direct operation of motor 174, blower fan 184, or heating system 172 in response to the position of the one or more selector inputs.

As used herein, "processing device" or "controller" may refer to one or more microprocessors, microcontroller, ASICS, or semiconductor devices and is not restricted necessarily to a single element. The controller 210 may be programmed to operate second laundry appliance 200 by executing instructions stored in memory (e.g., non-transitory media). The controller 210 may include, or be associated with, one or more memory elements such as RAM, ROM, or electrically erasable, programmable read only memory (EEPROM). For example, the instructions may be software or any set of instructions that when executed by the processing device, cause the processing device to perform operations.

Referring now to FIG. 2 and FIGS. 5 through 9, the exemplary stacking mount assembly 300, and components thereof, are provided. The exemplary stacking mount assembly 300 may advantageously be provided for installing, mounting, or securing a pair of laundry appliance (e.g., the first laundry appliance 100 and the second laundry appliance 200) within a dedicated space (e.g., an alcove or closet) within the passenger compartment of the RV 10 or within a mobile home. The stacking mount assembly 300 may advantageously allow the pair of laundry appliances to be stacked in the dedicated space. For example, the stacking mount assembly 300 may advantageously allow an operator to install, mount, and secure, a first laundry appliance 100 (e.g., a washing machine appliance) on top of a second laundry appliance 200 (e.g., a dryer appliance).

In addition, the stacking mount assembly 300 may advantageously improve an installation time of the pair of laundry appliances within the dedicated space. For example, the stacking mount assembly 300 may advantageously eliminate the need for an installation template (e.g., a paper installation template). Further, the stacking mount assembly 300 may advantageously arrest (e.g., prevent or mitigate) forward movement of the at least one of the laundry appliances of the pair of laundry appliances. For example, the stacking mount assembly 300 may advantageously receive leveling feet of the bottom most laundry appliance (e.g., the front leveling legs 103 or the rear leveling legs 105 of the first laundry appliance 100) and arrest forward movement of the bottom most laundry appliance by engaging with the leveling feet.

Figure 5:
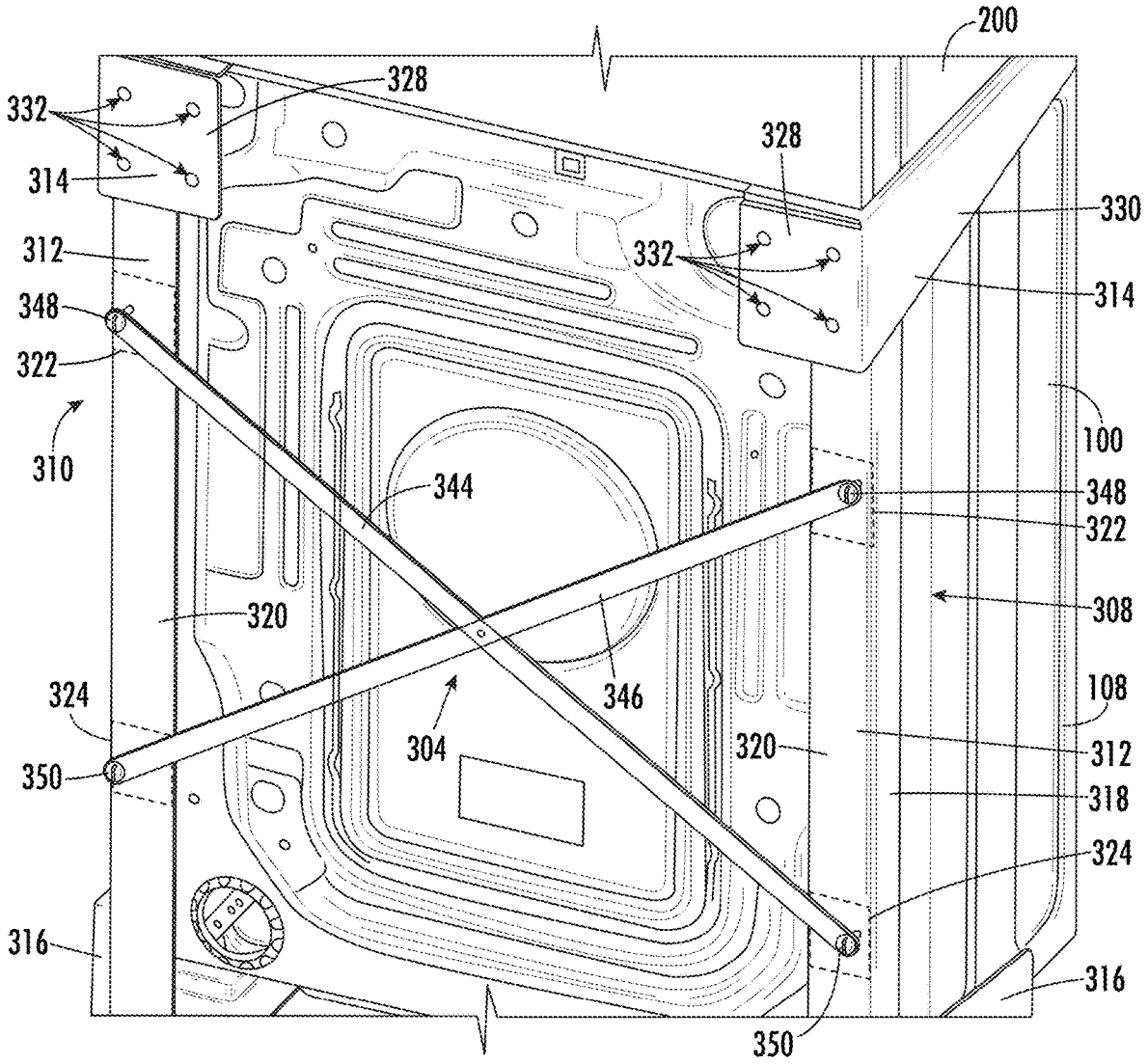
FIG. 5 provides a rear perspective view of a dryer appliance and a washing machine appliance mounted on a stacking mount assembly that can be positioned within the recreational vehicle of FIG. 1 according to one or more exemplary embodiments of the present disclosure.
Figure 6:
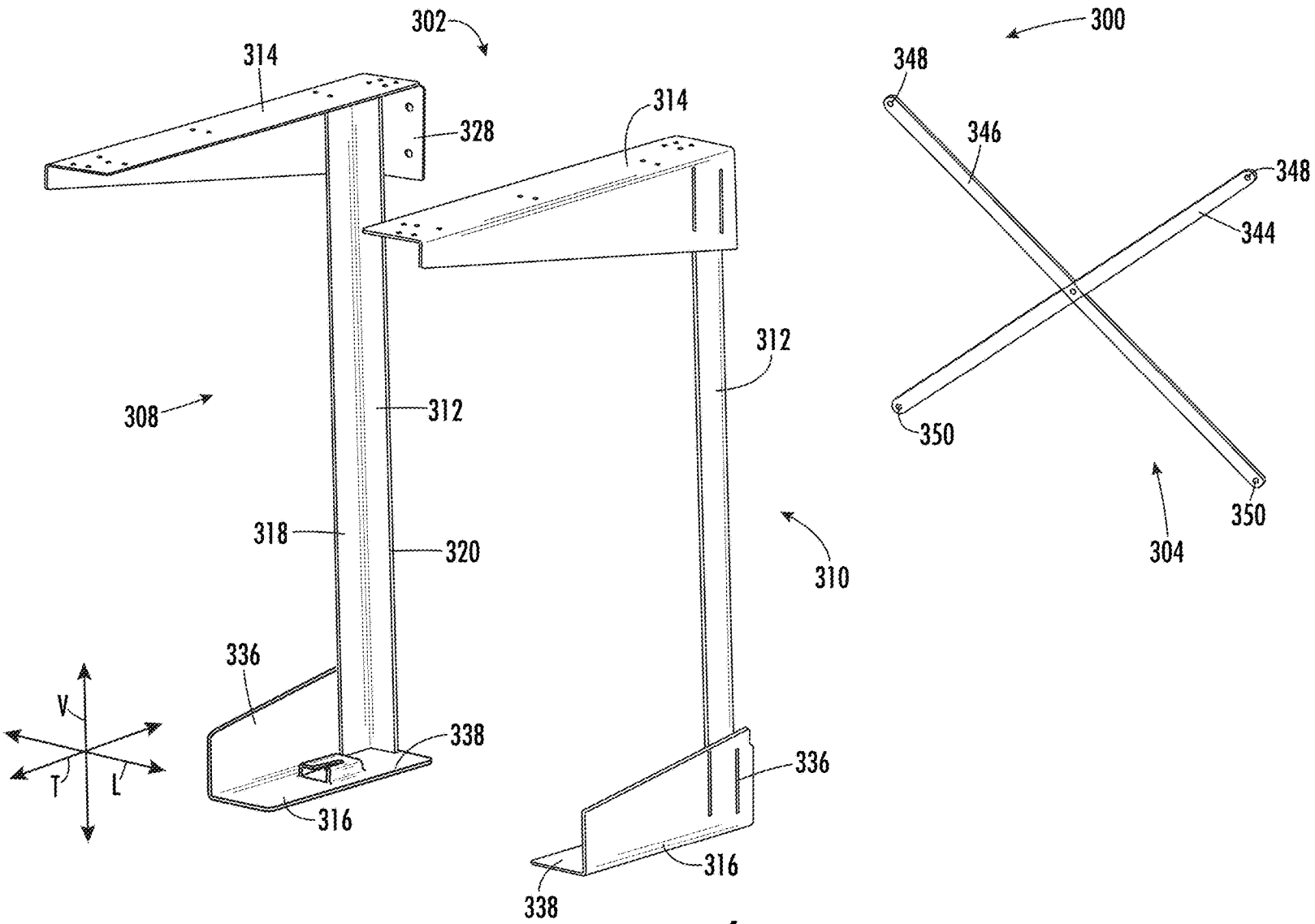
FIG. 6 provides an exploded view of a portion of the stacking mount assembly of FIG. 2.
Figure 7:
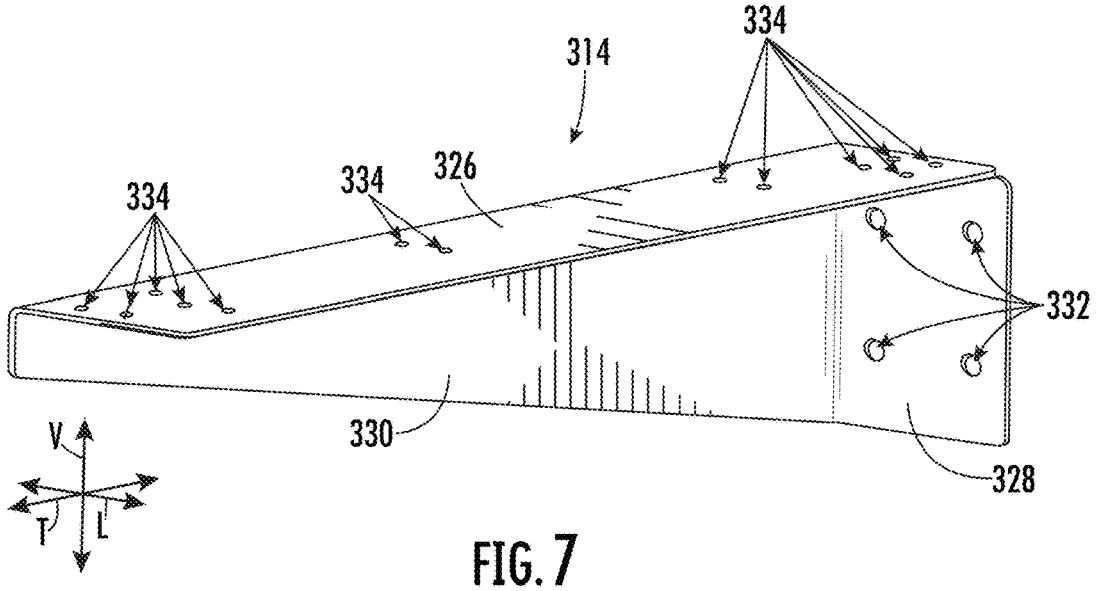
FIG. 7 provides a perspective view of a top bracket of the stacking mount assembly of FIG. 2.
Figure 8:
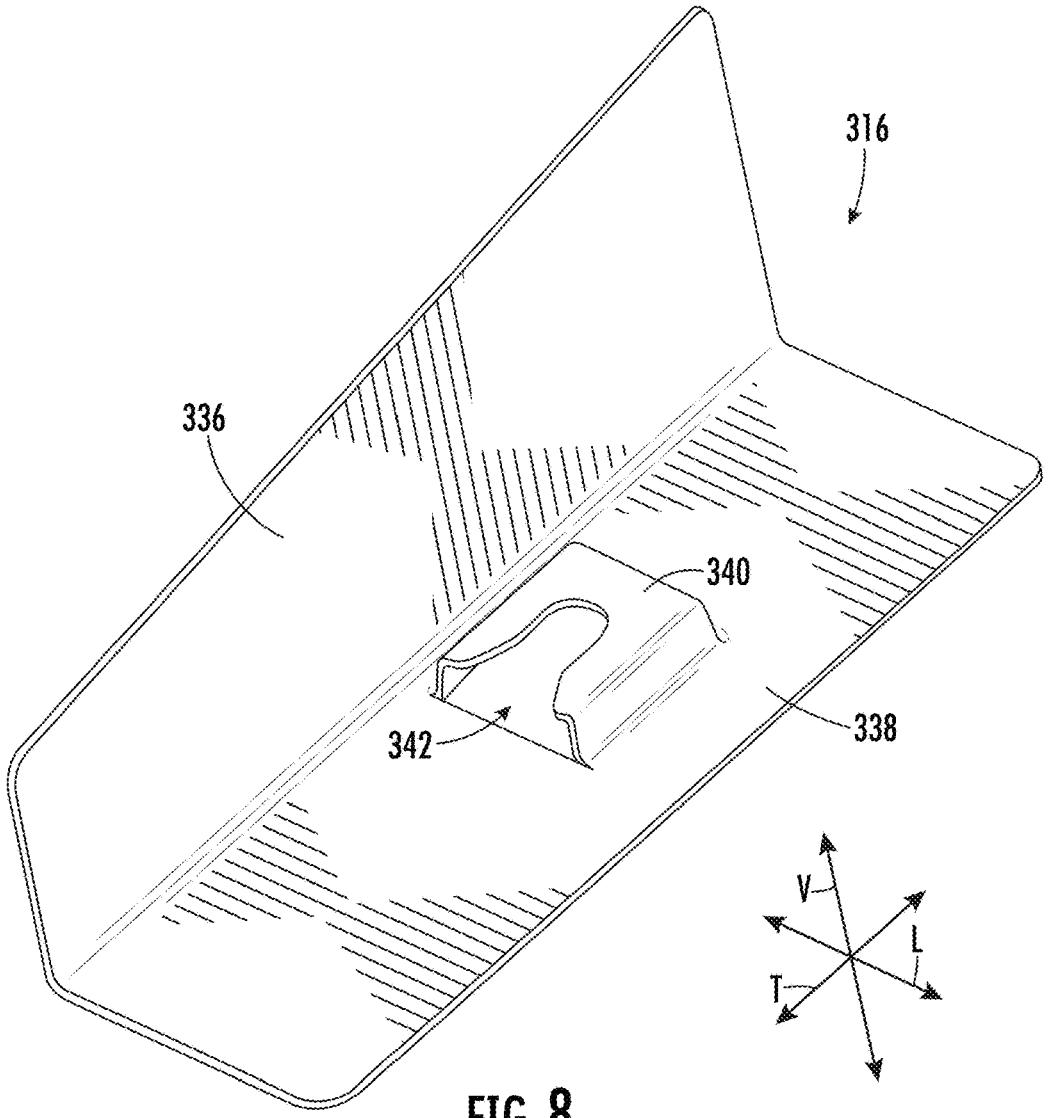
FIG. 8 provides a perspective view of a bottom bracket of the stacking mount assembly of FIG. 2.
Figure 9:
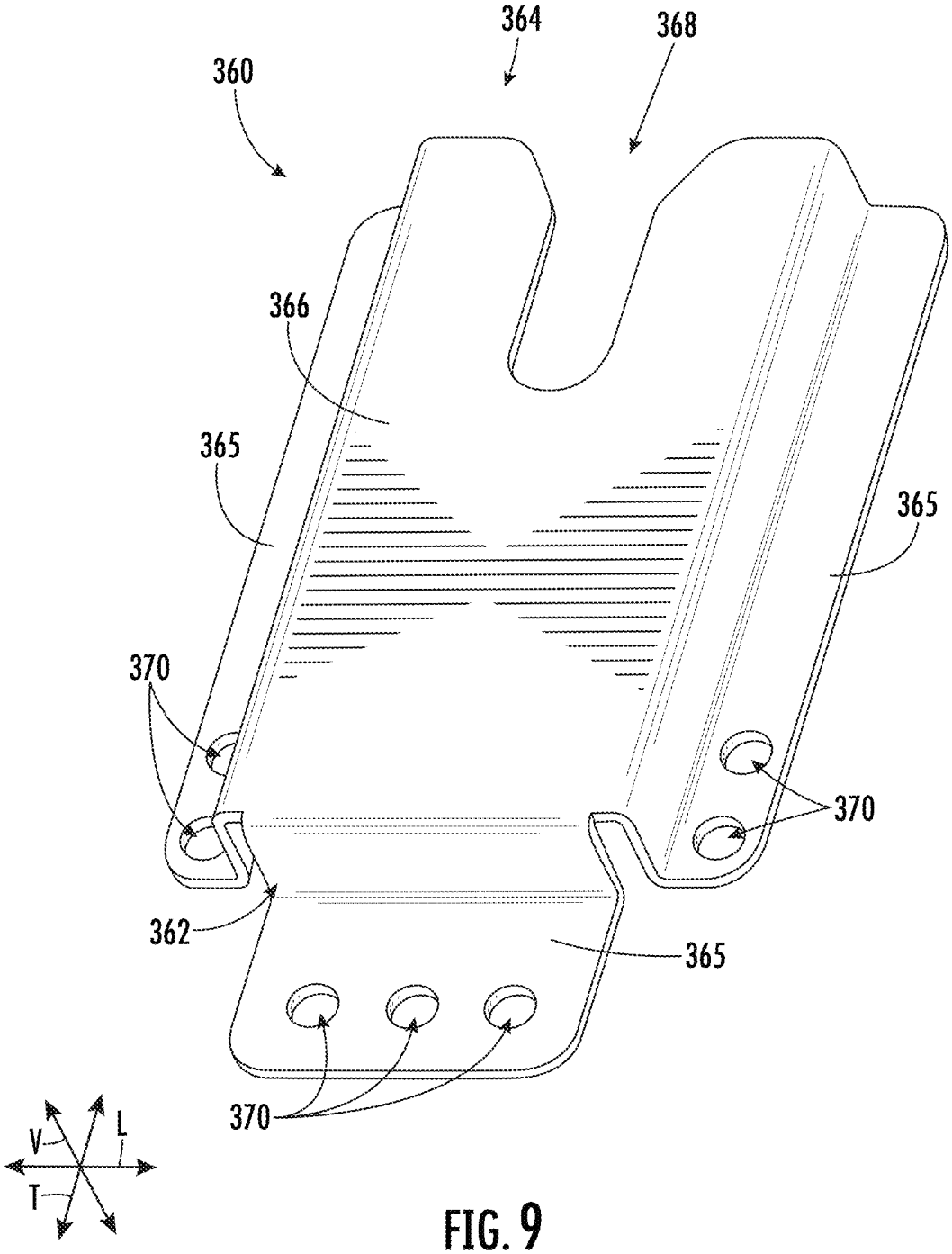
FIG. 9 provides a perspective view of a front foot bracket of the stacking mount assembly of FIG. 2

In some embodiments, the stacking mount assembly 300 includes a rack assembly 302, a crossbeam 304, and a front foot assembly 306. The rack assembly 302 include the main mounting components of the stacking mount assembly 300. For instance, the rack assembly 302 may include a first rack 308 and a second rack 310 that the first laundry appliance 100 or the second laundry appliance 200 may be secured or mounted to. The first rack 308 and the second rack 310 may be spaced apart along the lateral direction L. Moreover, the first rack 308 and the second rack 310 may be positioned at either lateral end of the pair of laundry appliances. For example, as depicted in FIGS. 2, 5 and 6, the first rack 308 may be positioned at or proximity to a first side 108 of the first laundry appliance 100 and the second rack 310 may be positioned at or proximate the second side of the first laundry appliance 100.

In some embodiments, the first rack 308 and the second rack 310 each include a vertical support beam 312, a top bracket 314, and a bottom bracket 316. Generally, the bottom bracket 316 of the first rack 308 or the second rack 310 may be positioned at a bottom end (e.g., along the vertical direction V) of the respective vertical support beam 312. As will be appreciated in more detail below, the bottom bracket 316 of the first rack 308 or the second rack 310 may be mounted to a first predetermined surface (e.g., a floor within the RV 10) to secure the rack assembly 302 in place. Each bottom bracket 316 may also receive a rear leveling legs 105 of the first laundry appliance 100.

In addition, each top bracket 314 of the first rack 308 or the second rack 310 may be positioned at a top end of the respective vertical support beam 312. As will be appreciated in more detail below, in some embodiments, each top bracket 314 of the first rack 308 or the second rack 310 is mounted to a second predetermined surface (e.g., a wall of within the RV 10) to secure the rack assembly 302 in place. Further, the second laundry appliance 200 may be placed on top of or mounted to each top bracket 314 of the first rack 308 or the second rack 310.

In some embodiments, each vertical support beam 312 of the first rack 308 or the second rack 310 includes a side member 318 and a rear member 320. The side member 318 of each vertical support beam 312 may extend parallel to a side (e.g., the first side 108 or the second side 110) of the first laundry appliance 100. The rear member 320 of each vertical support beam 312 may extend parallel to the rear side 114 of the first laundry appliance 100. In this regard, each vertical support beam 312 may "wrap" around (e.g., may be positioned around) a rear vertical edge of the first laundry appliance 100.

In addition, the rear member 320 of each vertical support beam 312 may include a first mounting portion 322 and a second mounting portion 324. The first mounting portion 322 and the second mounting portion 324 of each rear member 320 may be utilized in mounting a bracing member (e.g., the first beam 344 or the second beam 346 of the crossbeam 304 described in more detail below). The bracing members may brace or support the first rack 308 and the second rack 310. For instance, the bracing members may provide rigidity between the first rack 308 and the second rack 310 and may define the lateral distance between the first rack 308 and the second rack 310.

The first mounting portion 322 of each vertical support beam 312 may be positioned at a first height. In some embodiments, the first height is the distance between a bottom most edge of the bottom bracket 316 and the first mounting portion 322. The second mounting position of each vertical support beam 312 may be positioned at a second height. In some embodiments, the second height is the distance between a bottom most edge of the respective bottom bracket 316 and the second mounting portion 324. In addition, in some embodiments, the first height may be greater than the second height. In this regard, the first mounting portion 322 of a respective vertical support beam 312 may be positioned above (e.g., higher along the vertical direction V) than the second mounting portion 324 of the respective vertical support beam 312.

Each top bracket 314 of the first rack 308 or the second rack 310 may include a top plate 326, a rear plate 328, and a side plate 330. In some embodiments, the rear plate 328 of each top bracket 314 defines a plurality of wall fastener holes 332 therethrough. In some embodiments, a mechanical fastener (e.g., a screw, a bolt, etc.) may be driven through each fastener hole of the fastener holes to secure or mount the top bracket 314 to the second predetermined surface (e.g., a wall within the RV 10). For example, the rear plate 328 of each top bracket 314 may define four wall fastener holes 332 therethrough. In such instance, four fasteners (e.g., mechanical fasteners such as screws, bolts, etc.) may be driven through the fastener holes and into the second predetermined surface to secure or mount the top bracket 314 to the second predetermined surface.

Further, the second laundry appliance 200 may be placed on top of or mounted to each top bracket 314 of the first rack 308 or the second rack 310. In some embodiments, the top plate 326 of each top bracket 314 may define a plurality of appliance fastener holes 334 therethrough. In some embodiments, a fastener (e.g., a mechanical fastener such as a screw, bolt, etc.) may be driven through each appliance fastener hole (e.g., along the vertical direction V) of the plurality of appliance fastener holes 334 and into corresponding holes defined at a bottom of the second laundry appliance 200, for instance, to secure or mount the second laundry appliance 200 to each top bracket 314 of the first rack 308 or the second rack 310.

Each bottom bracket 316 of the first rack 308 or the second rack 310 may generally include a side plate 336, a bottom plate 338, and a rear raised plate 340. The rear raised plate 340 of each bottom bracket 316 may be extended upward (e.g., along the vertical direction V) from the respective bottom plate 338. The rear raised plate 340 may define a slot or an opening therethrough. In addition, the bottom plate 338 may define an opening therethrough. Together, the opening defined through the rear raised plate 340 and the opening defined through the bottom plate may define a rear foot opening 342 for receiving the rear leveling leg 105 of the first laundry appliance 100.

As briefly mentioned above, the crossbeam 304 may brace or support the rack assembly 302. Particularly, the crossbeam 304 may be attached to both the first rack 308 and the second rack 310 to provide structural rigidity to the rack assembly 302. In some embodiments, the crossbeam 304 include a first beam 344 and a second beam 346. The first beam 344 and the second beam 346 may each extend between a first end 348 and a second end 350. The first beam 344 and the second beam 346 may each extend between the vertical support beam 312 of the first rack 308 and the vertical support beam 312 of the second rack 310 in a cross formation. Particularly, in the cross formation the first end 348 of the first beam 344 may be coupled to the first mounting portion 322 of the vertical support beam 312 of the second rack 310. For example, the first end 348 of the first beam 344 may be fastened (e.g., mechanically fastened via screws, bolts, etc., or permanently fastened via rivets, welds, etc.) to the first mounting portion 322 of the second rack 310. The second end 350 of the first beam 344 may be coupled to the second mounting portion 324 of the vertical support beam 312 of the first rack 308. For example, the second end 350 of the first beam 344 may be fastened (e.g., mechanically fastened via screws, bolts, etc., or permanently fastened via rivets, welds, etc.) to the second mounting portion 324 of the second rack 310. The first end 348 of the second beam 346 may be coupled to the first mounting portion 322 of the vertical support beam 312 of the first rack 308. For example, the first end 348 of the second beam 346 may be fastened (e.g., mechanically fastened via screws, bolts, etc., or permanently fastened via rivets, welds, etc.) to the first mounting portion 322 of the first rack 308. The second end 350 of the second beam 346 may be coupled to the second mounting portion 324 of the vertical support beam 312 of the second rack 310. For example, the second end 350 of the second beam 346 may be fastened (e.g., mechanically fastened via screws, bolts, etc., or permanently fastened via rivets, welds, etc.) to the second mounting portion 324 of the second rack 310.

It should be appreciated that the cross formation of the first beam 344 and the second beam 346 may be provided by way of example only. In alternative exemplary embodiments, any suitable arrangement of the first beam 344 or the second beam 346 may be deployed. For instance, the first beam 344 or the second beam 346 may be in a parallel arrangement between the first rack 308 and the second rack 310. In addition, it should be appreciated that the number of beam (e.g., two beams) is provided by way of example only. In alternative exemplary embodiments, any suitable number of beams may be utilized. For example, in some alternative embodiments only one beam may be utilized to brace the first rack 308 and the second rack 310. As another example, in some other alternative exemplary embodiments, three or more beams (e.g., four beams) may be utilized to brace the first rack 308 and the second rack 310.

The front foot assembly 306 may arrest forward movement of the first laundry appliance 100. For instance, the front foot assembly 306 may include a pair of front foot brackets 360 (e.g., first font foot bracket and a second front foot bracket spaced apart along the lateral direction L). Each front foot bracket 360 may receive the front leveling legs 103 of the first laundry appliance 100. Each front foot bracket 360 may be mounted or secured to the second predetermined surface (e.g., a floor within the RV 10) at a predetermined distance (e.g., along the transverse direction T) from the rack assembly 302. Particularly, the predetermined distance may be a distance between the bottom brackets 316 of the rack assembly 302 and front foot brackets 360, respectively.

Each front foot bracket 360 may define a front end 362 and a rear end 364. Each front foot bracket 360 may include one or more mounting plates 365 and a front raised plate 366. In some embodiments, the one or more mounting plates 365 includes a pair of side mounting plates and a front mounting plate. Each side mounting plate may extend outward (e.g., along the lateral direction L) from the front raised plate 366. The front mounting plate may extend outward (e.g., along the transverse direction T) from the front raised plate 366. The front raised plate 366 of each front foot bracket 360 may be extended upward (e.g., along the vertical direction V). The front raised plate 366 may define a front foot opening 368 at the rear end 364 of the respective front foot bracket 360. The one or more mounting plates 365 of the first front foot bracket may each define one or more floor fastener holes 370 therethrough. In some embodiments, one or more fasteners (e.g., mechanical fasteners such as screws, bolts, etc.) may be driven through the one or more floor fasteners holes 370 and into the second predetermined surface to secure the respective front foot bracket 360 to the second predetermined surface.

As mentioned above, a stacking mount assembly may be utilized in installing, mounting, and securing a pair of laundry appliances (e.g., a washing machine appliance and a dryer appliance) within a small area or space, such as an alcove or a closet within a recreational vehicle or mobile home. Specifically, during installation, the stacking mount assembly advantageously allow an operator to mount the first rack and the second rack to a first predetermined surface (e.g., a wall within a RV or mobile home). Once mounted to the wall, an operator may install and secure a laundry appliance (e.g., a dryer appliance) on the top brackets of the first rack and the second rack. The operator then may install and secure an additional laundry appliance (e.g., washing machine appliance) to the bottom brackets of the first rack and the second rack. In addition, the stacking mount assembly advantageously includes a front foot assembly installed around the front leveling legs of the bottom most laundry appliance. The front foot assembly may arrest forward movement of the bottom most laundry appliances. In this regard, the stacking mount assembly may allow an operator to install a pair of laundry appliances directly into a dedicated space without need for a template (e.g., no marking is required on the floor for mounting feet bracket).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A stacking mount assembly for mounting a dryer appliance and a washing machine appliance, the stacking mount assembly defining a vertical direction, a lateral direction, and a transverse direction, the stacking mount assembly comprising:

a rack assembly comprising a first rack and a second rack spaced apart along the lateral direction, the first rack comprising a first vertical support beam, a first top bracket, and a first bottom bracket, the first top bracket being positioned at a top end of the first vertical support beam, the first bottom bracket being positioned at a bottom end of the first vertical support beam, the second rack comprising a second vertical support beam, a second top bracket, and a second bottom bracket, the second top bracket being positioned at a top end of the second vertical support beam, the second bottom bracket being positioned at a bottom end of the second vertical support beam;

a crossbeam bracing the rack assembly, the crossbeam comprising a first beam and a second beam, the first beam and the second beam each extending between the first vertical support beam and the second vertical support beam, the first beam and the second beam arranged in a cross formation; and a front foot assembly comprising a first font foot bracket and a second front foot bracket spaced apart along the lateral direction;

wherein the dryer appliance is mounted to the first top bracket and the second top bracket, and wherein each of the first front foot bracket and the second front foot bracket define a front foot opening for receiving a front foot of the washing machine appliance.

2. The stacking mount assembly of claim 1, wherein the first top bracket comprises a top plate, a rear plate, and a side plate, wherein the second top bracket each comprise a top plate, a rear plate, and a side plate, wherein the top plate of the first top bracket and the top plate of the second top bracket each define a plurality of appliance fastener holes therethrough, and wherein the rear plate of the first top bracket and the rear plate of the second top bracket each define a plurality of wall fastener holes therethrough.

3. The stacking mount assembly of claim 2, wherein the dryer appliance is mechanically mounted to the top plate of the first top bracket and the top plate of the second top bracket at the plurality of appliance fastener holes.

4. The stacking mount assembly of claim 2, wherein the rack assembly is mechanically mounted to a wall of a recreational vehicle at the plurality of wall fastener holes.

5. The stacking mount assembly of claim 1, wherein the first bottom bracket comprises a bottom plate and a rear raised plate, wherein the second bottom bracket comprises a bottom plate and a rear raised plate, wherein the rear plate of the first bottom bracket is extended upward along the vertical direction from the bottom plate of the first bottom bracket, wherein the rear plate of the first bottom bracket and the bottom plate of the first bottom bracket together define a rear foot opening for receiving a rear foot of the washing machine appliance, wherein the rear plate of the second bottom bracket is extended upward along the vertical direction from the bottom plate of the second bottom bracket, and wherein the rear plate of the second bottom bracket and the bottom plate of the second bottom bracket together define a rear foot opening for receiving a rear foot of the washing machine appliance.

6. The stacking mount assembly of claim 1, wherein the first vertical support beam comprises a side member and a rear member, wherein the second vertical support beam comprises a side member and a rear member, wherein the rear member of the first vertical support beam comprises a first mounting portion and a second mounting portion, wherein the rear member of the second vertical support beam comprises a first mounting portion and a second mounting portion, wherein the first mounting portion of the first vertical support beam and the first mounting portion of the second vertical support beam are positioned at a first height, wherein the second mounting position of the first vertical support beam and the second mounting portion of the second vertical support beam are positioned at a second height, and wherein the first height is greater than the second height.

7. The stacking mount assembly of claim 1, wherein the first beam extends between a first end and a second end, wherein the second beam extends between a first end and a second end, wherein the first end of the first beam is coupled to the first mounting portion of the first vertical support beam, wherein the second end of the first beam is coupled to the second mounting portion of the second vertical support beam, wherein the first end of the second beam is coupled to the first mounting portion of the second vertical support beam, and wherein the second end of the second beam is coupled to the second mounting portion of the first vertical support beam.

8. The stacking mount assembly of claim 1, wherein the first front foot bracket defines a front end and a rear end, wherein the first front foot bracket comprises one or more mounting plates and a front raised plate, wherein the front raised plate of the first front foot bracket is extended upward along the vertical direction from the one or more mounting plates of the first front foot bracket, wherein the front raised plate of the first front foot bracket defines a front foot opening at the rear end of the first front foot bracket for receiving a first front foot of the washing machine appliance, wherein the second front foot bracket defines a front end and a rear end, wherein the second front foot bracket comprises one or more mounting plates and a front raised plate, wherein the front raised plate of the second front foot bracket is extended upward along the vertical direction from the one or more mounting plates of the second front foot bracket, and wherein the front raised plate of the second front foot bracket defines a front opening at the rear end of the second front foot bracket for receiving a second front foot of the washing machine appliance.

9. The stacking mount assembly of claim 8, wherein the one or more mounting plates of the first front foot bracket defines one or more floor fastener holes therethrough, wherein the one or more mounting plates of the second front foot bracket defines one or more floor fastener holes therethrough, wherein the first front foot bracket is mechanically coupled to a floor of a recreational vehicle at the one or more floor fastener holes, and wherein the second front foot bracket is mechanically coupled to the floor of the recreational vehicle at the one or more floor fastener holes.

10. A stacking mount assembly for mounting a pair of laundry appliances, the stacking mount assembly comprising:

a rack assembly comprising a pair of racks spaced apart, each rack comprising a vertical support beam, a top bracket positioned at a top of the respective vertical support beam, and a bottom bracket positioned at a bottom of the respective vertical support beam, a first laundry appliance of the pair of laundry appliances mounted to each top bracket of the pair of racks, a second laundry appliance of the pair of laundry appliances secured to a first predetermined surface at each bottom bracket of the pair of rack; and a crossbeam attached to the rack assembly for bracing the rack assembly, the crossbeam comprising a pair of beams attached between the pair of racks, the pair of beams arranged in a cross formation.

11. The stacking mount assembly of claim 10, further comprising:

a front foot assembly coupled to the first predetermined surface for securing the second laundry appliance to the first predetermined surface, the front foot assembly comprising a pair of front foot brackets spaced apart along the lateral direction, each front foot bracket of the pair of front foot brackets defining a front foot opening for receiving a front foot of the second laundry appliance.

12. The stacking mount assembly of claim 11, wherein each front foot bracket of the pair of front foot brackets defines a front end and a rear end, wherein each front foot bracket of the pair of front foot brackets comprises one or more mounting plates and a front raised plate, wherein each front raised plate is extended upward from the respective one or more mounting plates, and wherein each front raised plate defines a front opening at the rear end thereof for receiving the front foot of the second laundry appliance.

13. The stacking mount assembly of claim 12, wherein one or more mounting plates of each of the front foot brackets defines one or more floor fastener holes therethrough, wherein each front foot bracket is mechanically mounted to a predetermined surface at the one or more floor fastener holes.

14. The stacking mount assembly of claim 10, wherein the top bracket of each rack comprises a top plate, a rear plate, and a side plate, wherein the top plate defines a plurality of appliance fastener holes therethrough, and wherein the rear plate of each top bracket defines a plurality of wall fastener holes therethrough.

15. The stacking mount assembly of claim 14, wherein the first appliance is mechanically mounted to the top bracket of each rack at the plurality of appliance fastener holes.

16. The stacking mount assembly of claim 14, wherein the stacking mount assembly is mechanically mounted to a predetermined surface at the plurality of wall fastener holes.

17. The stacking mount assembly of claim 10, wherein the bottom bracket of each rack comprises a bottom plate and a rear raised plate, wherein each rear raised plate is extended upward from the respective bottom plate, and wherein each rear raised plate and the respective bottom plate define a rear foot opening for receiving a rear foot of the second laundry appliance.

18. The stacking mount assembly of claim 10, wherein each vertical support beam of comprises a side member and a rear member, wherein the rear member comprises a first mounting portion and a second mounting portion, wherein the first mounting portion of the rear member is at a first height, wherein the second mounting portion of the rear member is at a second height, and wherein the first height is greater than the second height.

19. The stacking mount assembly of claim 10, wherein the pair of laundry appliances comprises a washing machine appliance and a dryer appliance.

20. The stacking mount assembly of claim 19, wherein the washing machine appliance and the dryer appliance are mounted within a recreational vehicle via the stacking mount assembly.

* * * * *